United States Patent [19]

Muller et al.

[11] 4,423,965

[45] Jan. 3, 1984

[54] ELONGATED CLOCK

[76] Inventors: Johannes F. J. M. Muller, Dijkstraat 1, 5398 JP Maren-Kessel; Joannes A. M. Van Dongen, Burchtenlaan 174, 5235 GN 's-Hertogenbosch, both of Netherlands

[21] Appl. No.: 431,350

[22] Filed: Sep. 30, 1982

[51] Int. Cl.[3] ..... G04B 45/00; G04B 19/02; G04B 13/02

[52] U.S. Cl. ..... 368/78; 368/222; 368/235

[58] Field of Search ..... 368/77, 78, 221, 222, 368/235, 322, 323, 62, 76, 220

[56] References Cited

U.S. PATENT DOCUMENTS

| | | | |
|---|---|---|---|
| 726,276 | 4/1903 | Fitch | 368/78 |
| 733,180 | 7/1903 | Fitch | 368/78 |
| 2,687,003 | 8/1954 | Junghans et al. | 368/78 |
| 2,734,338 | 2/1956 | Uhlig et al. | 368/78 |
| 3,177,645 | 4/1965 | Devanney | 368/78 |
| 3,220,174 | 11/1965 | Cappellari | 368/78 |
| 3,898,792 | 8/1975 | Insley et al. | 368/78 X |
| 3,953,965 | 5/1976 | Tobeta | 368/222 |
| 3,979,898 | 9/1976 | Werkes | 368/78 |
| 4,044,548 | 8/1977 | Rowbottam | 368/222 |

*Primary Examiner*—J. V. Truhe
*Assistant Examiner*—Terrance Flower
*Attorney, Agent, or Firm*—Conlon & Kerstein

[57] ABSTRACT

An elongated clock includes a pair of adjacent, cylindrical, rolls providing one roll with five minute segments indicated and a second roll with twelve hours of morning and evening indicated. These rolls are mounted about a shaft connected with a constant speed motor which rotates the minute cylinder at a constant rate. A gearing arrangement at the end of the shaft couples the shaft with the roll indicating hours and turns the hour roll once every hour. A segmented drive gear is coupled to the shaft and includes a pair of teeth which engage a pinion which in turn has every tooth meshing with a gear attached to turn the hour roll. Thus, one complete rotation of the shaft produces one-twelfth of a full rotation of the hour roll. The pinion gear is prevented from overriding after indexing because a locking rim of the segmented drive gear nestles into gear teeth extensions of every other tooth of the pinion gear.

7 Claims, 5 Drawing Figures

TWENTY FIVE MINUTES TO
TWENTY MINUTES TO
A QUARTER TO
TEN MINUTES TO
FOUR
FIVE
SIX
SEVEN
10
12
12
14
15
15a
19
21
2
2

12
12
13
13
14
14
16
16
17
17
18
18a
19
19
20
20
21
21
22
23
26
27
28
34
36
37
38
38

ELONGATED CLOCK

BACKGROUND OF THE INVENTION (1) Field of the Invention

This disclosure pertains to clock mechanisms and in particular to a mechanism for operating a so-called tube type or cylindrical clock having a pair of internal rotating members, one which indicates minutes in five minute segments and the other which indicates hours in twelve segments.

(2) Description of the Prior Art

A number of gearing mechanisms have evolved over the years to drive clocks ranging from pendulum clocks to modern day digital read out clocks. However, it is believed that this is the first such clock provided which displays minutes and hours on rolls adjacent one another in such a fashion that the minute rolls index every five minutes and produce a corresponding, indexing or rotation of the hour indicating roll once per hour. The prior art does not show clocks having the unique gearing arrangement provided herein which not only indexes the hour roll on an hourly basis, but also prevents override or slippage of the hour roll once the indexing has occurred.

SUMMARY

This disclosure pertains to a clock, having cylindrical, internal roll members mounted within a larger, transparent cylinder. More specifically, the internal roll members consist of a larger elongated roll divided into twelve segments with six segments indicating five minute intervals after the hour and six segments indicating five minute intervals before the following hour. A second roll is mounted adjacent to the minute roll and is likewise divided into twelve segments, each representing an hour of the day. As the minute roll rotates indicating five minute intervals after the hour, the hour roll remains in place. When the minute roll reaches a point where it indicates five minute intervals before the following hour, then the hour roll indexes to the next hour. An indicator is positioned on the outer cylinder to show the minutes and corresponding hours.

A constant speed, battery powered motor is located at one end of the cylinder and is coupled with a drive spindle shaft which extends the full length of the clock. At the end of the shaft opposite the drive motor is located a gearing arrangement including a drive gear coupled directly to the shaft and including only two teeth. A pinion gear is located adjacent the drive gear and includes eight teeth. Every other tooth extends the full width of the pinion and is adapted to function in conjunction with a rim of the drive gear to prevent override of the hour roll as it turns. The full complement of eight teeth on the pinion gear mesh with the two teeth of the drive gear and also mesh with a gear attached to rotate the hour roll. Thus, one rotation of the drive gear produces only a partial rotation of the pinion gear and a corresponding one-twelfth rotation of the hour indicating roll. The drive gear has a rim having a top part located in the same plane around the perphiery as the top of the two gear members. The rim fits within the odd numbered teeth of the pinion. After the two teeth of the drive gear pass the pinion, the rim member nestles within the full length teeth of the pinion to prevent further rotation of the pinion and thus prevent slippage or override during operation of the clock.

It is thus an object of this disclosure to provide an elongated, cylindrical clock member having a pair of adjacent segments to indicate the hours and minutes of a day.

Yet another object of this disclosure is to provide an elongated clock member with a drive gear mechanism comprising a segmented gear adapted to engage a pinion member once every revolution and move the pinion member thirty degrees or one-twelfth of a complete revolution to thus change the hours in advancing fashion.

It is yet another object of this disclosure to provide a drive gear and associated pinion having a rotation control mechanism which prevents override or slippage of the driven cylinder by providing a rim portion to the drive gear which nestles within extended teeth of the pinion after the pinion is rotated. Thus, when the clock is manually adjusted at a relatively high rate of speed, there is no override of the hour cylinder because of this motion control feature.

These and other objects of the disclosure will become apparent to those having ordinary skill in the art with reference to the description, drawings and appended claims.

DESCRIPTION OF THE PREFERRED EMBODIMENT

Figure 1:
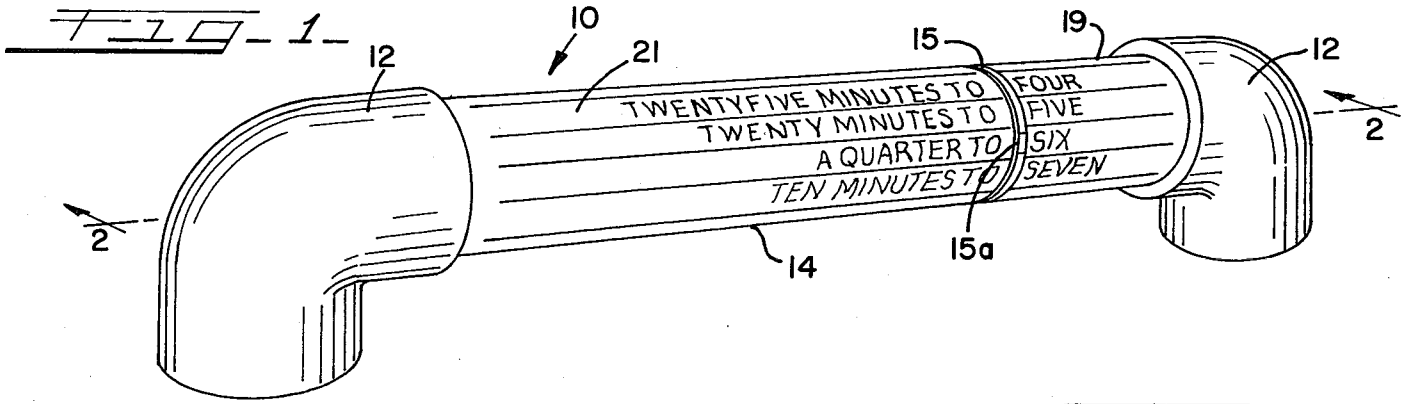
FIG. 1 is a pictorial illustration of the clock.

Referring now to the drawings and in particular to FIG. 1, there is shown pictorially the visual aspects of the clock disclosed herein. The clock is designated generally by the numeral 10 and includes a pair of support knees 12 located at each end. Essentially, the support knees have openings to receive a large, outer tube 14. The other end of each support knee 12 is closed off with cover plates 13 which have openings therein to allow the clock to be mounted on a flat, horizontal surface or mounted along a wall in a horizontal or vertical fashion.

Figure 2:
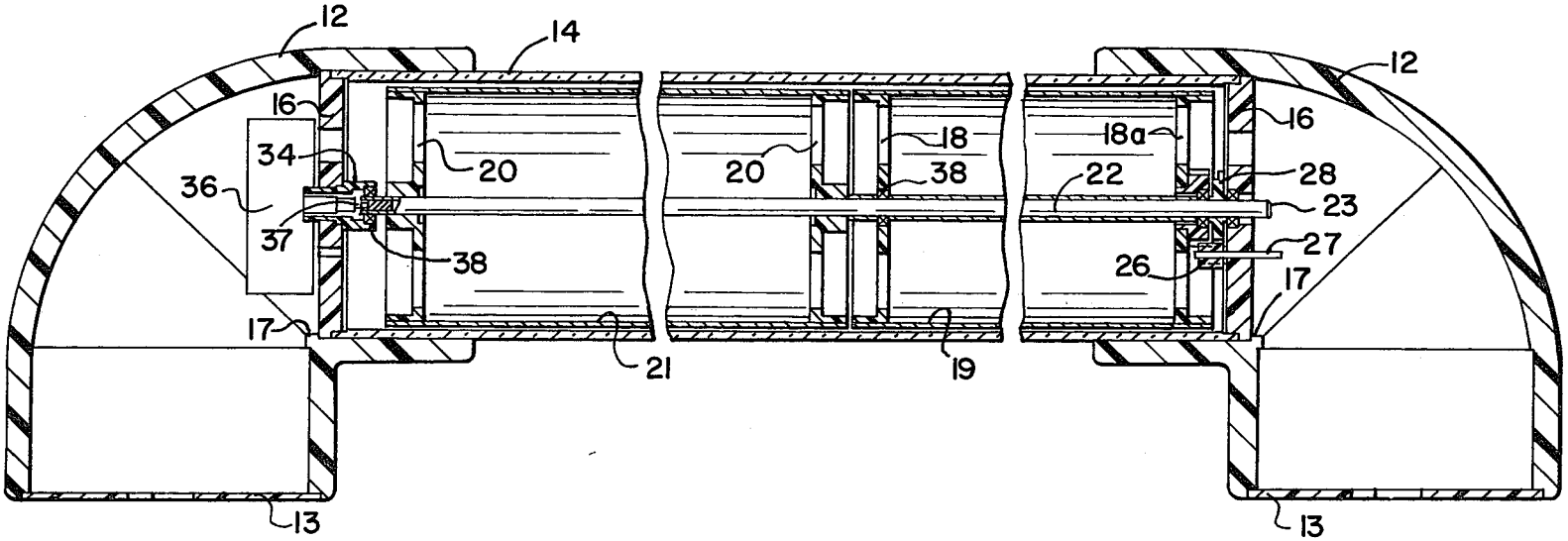
FIG. 2 is a sectional view taken generally along lines 2—2 of FIG. 1.
Figure 3:
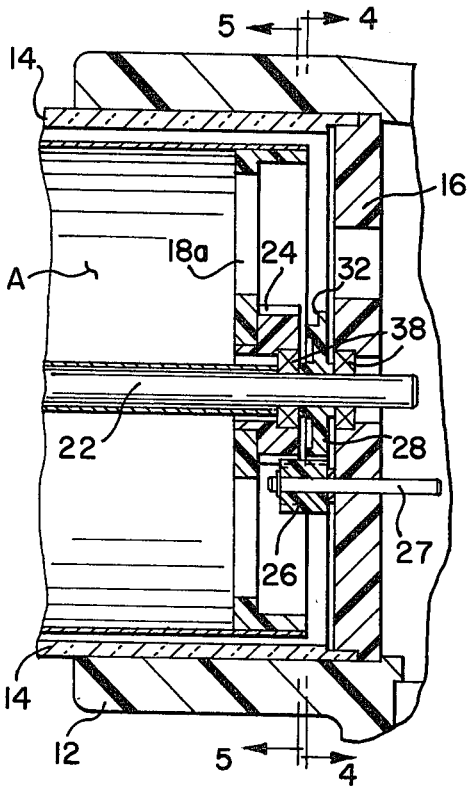
FIG. 3 is an enlarged view of the right, internal end of the clock shown in FIG. 2.

The tube 14 is a transparent, cylindrical member having a time indicator ring 15 and indicator **15*a* on its outer periphery and closed off at the right end as shown in FIG. 2 by a so-called tube flange 16. The tube flange 16 is stepped to fit partially within the tube 14 and yet provide an outer surface that will contact an internal stop 17 in the support knees 12 to prevent the tube 14 and tube flange 16 from being inserted too far into the knee 12 so that it becomes stuck. Two tube flanges 16 are contemplated as being identical members and are located at each end of the tube 14**.

Hour roll 19 and minute roll 21 are located within tube 14 and rotate on shaft 22. Drive spindle flanges 18, **18*a* close off each end of the hour roll cylinder 19. Minute flanges 20 close off each end of the minute cylinder or roll 21. It is contemplated that the rolls 19 and 21 are thin, cylindrical members formed of polyvinyl chloride (PVC). Flanges 18, 18*a* and 20** can also be cast from plastic.

As shown in FIG. 2, the rolls 19 and 21 are mounted about the elongated shaft 22. Shaft 22 has an extension 23 for manually setting the time. The minute flanges 20 are attached to the shaft 22 and move in unison therewith. On the other hand, the drive spindle or hour flanges 18, 18*a* do not move in unison with the shaft 22.

Figure 4:
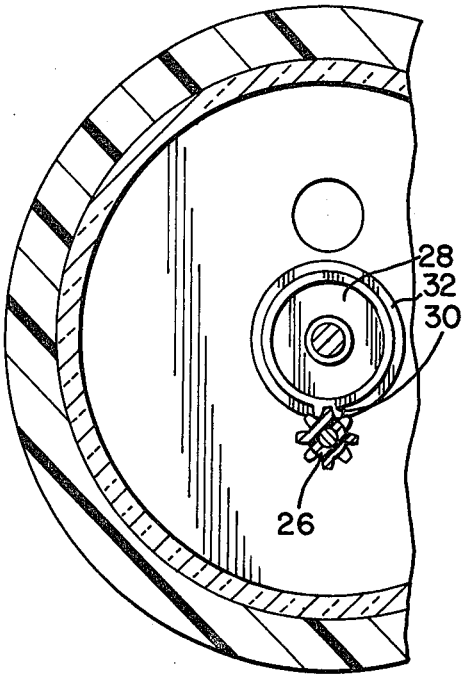
FIG. 4 is a partial sectional view taken generally along lines 4—4 of FIG. 3; and, FIG. 5 is a sectional view taken generally along lines 5—5 of FIG. 3.
Figure 5:
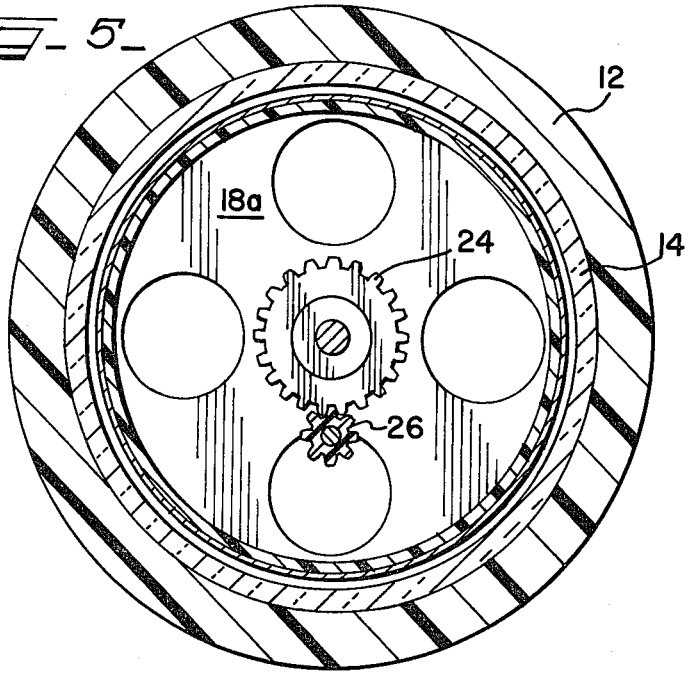

The outside drive spindle flange 18*a* has a gear 24 adjacent thereto which may be formed integrally therewith or as a separate part and then inserted therein and with a force fit or adhesive to prevent relative movement between the two members. The gear 24 has twenty-four teeth. A smaller, pinion gear 26 is mounted on a pinion shaft 27 (FIG. 2) and has eight teeth which mesh with the twenty-four teeth of the gear 24. A segmented drive gear 28 has only two full teeth and is mounted at the end of shaft 22 and attached thereto. Thus, rotation of the shaft produces identical rotation of the attached segmented drive gear 28. As shown in FIG. 4, the drive gear 28 includes only two teeth 30 and a rim 32. It also should be noted that pinion gear 26 includes two types of teeth. One half of the pinion has eight teeth which mesh with the gear 24. The other half of the pinion includes only four teeth which are extensions of every other tooth and of the eight tooth pinion. These longer teeth members are extensions and do not function as gear teeth in the commonly accepted sense but cooperate with the rim 32 after the teeth 30 have driven the pinion to thereby allow the rim to nestle within these teeth extensions (full teeth) to act as a stop to prevent additional rotation of the pinion except when driven by the drive gear 28.

As shown in FIG. 4, the segmented drive gear 28 has two teeth 30 which index with each of the eight teeth on the pinion 26. As mentioned earlier, of the eight teeth on pinion 26, four (every other tooth) extend further than the other four and extend completely across the pinion. The drive gear rotates at one revolution per hour. After the drive gear 28 meshes with teeth of the pinion gear 26 and index the pinion gear two teeth, the rim 32 then nestles within the full length teeth preventing further rotation of the pinion gear 26. This feature is important in preventing override as the clock hour cylinder rotates, is adjusted or moved suddenly.

In operation, the motor 36 turns shaft 22 at one revolution per hour. This shaft rotation turns the attached, segmented drive gear 28 at the same speed. As gear 28 rotates at one revolution per hour its two teeth 30 mesh with teeth of pinion 26 to turn it one quarter of a revolution (two teeth). The hour cylinder gear 24 is rotated by pinion 26 at the speed of one revolution every twelve hours. Thus, the drive pinion gear 26 rotates two teeth every hour causing the larger gear 24 which has twenty-four teeth to be driven two teeth or one-twelfth of a revolution to turn the hour roll 19 each hour to a new hour. It is observed that the minute roll 21 rotates a constant speed to indicate five minute intervals before and after each hour. The hour roll moves abruptly and quickly at the change of each hour when teeth 30 of the drive gear 28 rotate the pinion 26 and the larger gear 24 which in turn rotates with the hour cylinder 19.

The entire arrangement of components is powered by a drive motor 34 to which an adapter 36 is attached to allow the motor to be connected with the shaft 22. Also, a number of small roller bearings 38 may be utilized to mount the shaft in the various flanges 16, 18, 18*a* and 20 in order that it rotate smoothly and produce a minimum of drag. Thus, a very small horsepower motor can be used with a simple one and one half volt battery to power the motor. One type of motor which has been found effective is a quartz motor manufactured in Germany by Junghans and identified as model number W-757.

Thus, it has been shown by the foregoing that a novel type of clock has been disclosed whereby the large minute cylinder indicates five minute segments of time after each hour and then after indexing to the next hour indicates the time before the hour in five minute segments. The cylindrical time indicators 19, 21 are balanced as is the remainder of the clock and thus only a fractional power motor is used because there are no unbalanced forces. Even the drive gear which has only two teeth of a gear segment is balanced because of the locking rim which it is provided with. Similarly, the pinion member also is balanced and provides no uneven forces to be overcome by the drive motor.

The foregoing description and drawings merely explain and illustrate the invention and the invention is not limited thereto, except insofar as the appended claims are so limited, as those who are skilled in the art and have the disclosure before them will be able to make modifications and variations therein without departing from the scope of the invention.

What is claimed is:

1. A clock having an elongated body with segmented rotating members adapted to display the time, the improvement comprising:

a drive motor coupled to a shaft and disposed to turn the shaft at a constant speed;

a first time indicating roll cylinder having a length greater than its diameter and having twelve divisions, each division having a time interval indicated thereon and displaying minutes of an hour in words and also having means coupled to said shaft and adapting the first roll to rotate constantly in unison with the shaft;

a second time indicating roll having a length greater than its diameter and mounted for rotation about said shaft and also having twelve divisions, each division having a time interval indicated thereon and displaying the hours of one to twelve in words;

a drive gear means located at one end of the elongated body coupled with said shaft and adapted to produce rotation of the second roll;

pinion gear means adjacent the drive gear and engageable with said drive gear;

said second time indicating roll for displaying hours also having gear means associated therewith and said gear means being mounted to move in response to movement of said pinion gear to rotate the second roll;

said pinion gear having teeth formed about its periphery, said teeth engageable with said gear means and with the drive gear whereby one complete rotation of the drive gear produces indexing of the pinion gear and only partial rotation of the gear means and second, time indicating roll, elongated housing means encapsulating the first and second cylinders and having bearings to mount and receive each end of said shaft to permit rotation of the shaft for turning said cylinders to display the time.

2. The clock according to claim 1 and:

said drive gear means having two drive gear teeth and a rim extending about its periphery;

said pinion gear having teeth extensions adapted to be nestled about a portion of said rim after indexing of the pinion gear by the drive gear to thereby prevent movement of the pinion gear and the gear means which is connected with said second time indicating roll to prevent accidental and inadvertent movement of the second, time indicating roll.

3. The clock of claim 1 wherein:

said first time indicating roll includes a plurality of time indicating segments;

said time indicating segments having visual means which display minute intervals;

said second time indicating roll including twelve time segments to indicate hours;

indicating means located between said first and second rolls for associating the minutes and hours to display the time.

4. The clock of claim 1 and said housing means including:

a cylindrical, transparent housing surrounding said first and second rolls;

mounting members with means attached at each end of said cylindrical housing and including mounting and attaching means for affixing the clock to a stationary object.

5. The clock of claim 4 wherein said mounting members include:

enlarged elbows having a first opening to receive an end of said transparent housing and having a second opening;

mounting plate member located in the second opening of the elbow and having openings for attaching the clock to a vertical surface.

6. The clock of claim 1 and:

said drive gear means having two teeth for intermittently driving the pinion gear and said pinion gear means having eight teeth and being adapted to be driven by the drive gear means and to mesh with the drive the gear means attached to the second roll.

7. The clock of claim 1 and said shaft having an extension for manually adjusting the time by rotating said first and second rolls.

* * * * *